United States Patent [19]

Segawa

[11] 4,022,269

[45] May 10, 1977

[54] DIE CAST MACHINES

[75] Inventor: Kazuyoshi Segawa, Zama, Japan

[73] Assignee: Toshiba Kikai Kabushiki Kaisha, Tokyo, Japan

[22] Filed: July 23, 1976

[21] Appl. No.: 708,216

[30] Foreign Application Priority Data

July 31, 1975 Japan ..... 50-94083

[52] U.S. Cl. ..... 164/314; 60/416; 91/5; 91/6; 91/392; 222/334

[51] Int. Cl.² ..... B22D 17/08

[58] Field of Search ..... 164/154, 155, 314, 315; 222/334; 60/416; 91/5, 6, 24, 392, 403; 92/134

[56] References Cited

UNITED STATES PATENTS 3,891,126 6/1975 Segawa ..... 222/334

*Primary Examiner*—Robert D. Baldwin

*Attorney, Agent, or Firm*—Spensley, Horn & Lubitz

[57] ABSTRACT

In a die cast machine of the type wherein the piston of an injection cylinder is advanced by pressure gas admitted into the rear chamber of the cylinder while discharging pressurized liquid in the fore chamber, and the piston is retracted by pressurized liquid admitted into the fore chamber while forcing the gas in the rear chamber back into a gas accumulator, a control valve device is provided in the path of the pressurized liquid discharged from the fore chamber, and the control valve device is controlled so as to vary the flow quantity of the discharged pressurized liquid in accordance with the position of the piston during its forward movement. There are also provided two gas accumulators which are connected to the rear chamber of the cylinder through a valve device which is controlled so as to adjust the rate of increase of the pressure applied to the molten metal at the final stage of the injection casting operation.

9 Claims, 7 Drawing Figures

DIE CAST MACHINES

BACKGROUND OF THE INVENTION

This invention relates to an improvement of a die cast machine, more particularly an improved fluid pressure operating circuit for the injection cylinder described in U.S. Pat. No. 3,891,126 dated June 24, 1975.

According to this patent, the energy of the compressed gas contained in an accumulator is used for moving the piston of the injection cylinder of a die cast machine at an extremely high speed without accompanying an objectionable water hammering phenomenon thereby decreasing the time required for raising the pressure of cast molten metal and eliminating the problems of dimensional inaccuracy and fins caused by the water hammering phenomenon.

However, as a result of further investigation it was found that there remains problems to be solved as follows.

More particularly, in most (more than 90%) of the metal moulds now being used commercially a high rate of rise in the pressure applied to the molten metal at the final stage of injection is desirable but several % of the metal moulds have gaps between the mating surfaces of the mould halves due to a wear, deformation and manufacturing error of the metal moulds. When such metal mould is used if the rate of rise in the pressure applied to the molten metal were too high fins or flashes would be formed. Accordingly, it is necessary to slightly slow down (of the order of 1/1000 second) the rate of pressure rise at the sacrifice of the quality of the casting.

It has been considered that it is desirable to inject the molten metal at a constant speed into the mould cavity by the injection plunger and the die cast machine has been designed to meet this requirement. Thus, in the first stage of the injection, for the purpose of preventing a wave from being formed on the surface of the molten metal poured into an injection sleeve and exhasuting the air in the injection sleeve to the outside of the metal mould through an air vent, it is usual to move the injection plunger at a relatively slow constant speed or to gradually accelerate the plunger from a relatively low initial speed so that the plunger will attain a constant high speed when the molten metal reaches the gate of the metal mould.

However, the temperature and fluidity of the molten metal decrease with time so that the resistance to the movement of the injection plunger increases with the injection stroke. Accordingly, the injection plunger of the prior art machine does not move at a constant speed during the injection stroke but decelerates as the stroke proceeds. With such injection speed characteristic, as the speed of the molten metal flowing through the gate of the metal mould during the later stage becomes smaller than that of the molten metal flowing during the early stage with the result that the molten metal injected into the mould cavity becomes discontinuous thus entraining air bubbles in the casting, dislocations (phenomenon wherein separated metal portions do not fuse again), and surface defects of the cast products.

SUMMARY OF THE INVENTION

Accordingly it is an object of this invention to provide an improved die cast machine capable of obviating the difficulties described above.

Another object of this invention is to provide an improved die cast machine wherein the speed of the injection piston can be varied in accordance with a predetermined position thereof, or a predetermined time corresponding to said predetermined position during the forward movement of the piston thereby improving the quality of the casting.

Still another object of this invention is to vary the pressure applied to the molten metal injected into a mould cavity at the end of the forward movement of the injection piston.

According to this invention, these and other objects can be accomplished by providing a die cast machine including an injection cylinder and a piston contained therein for operating an injection plunger for injecting molten metal into a mould cavity, said piston dividing the interior of the cylinder into a fore chamber and a rear chamber, wherein pressurized gas from a gas accumulater is admitted into the rear chamber for advancing the piston and the injection plunger for injecting the molten metal into the mould cavity, and pressurized liquid is admitted into the fore chamber to retract the piston thereby forcing the gas in the rear chamber back into the gas accumulator, characterized in that a control valve means is connected in the discharge path of the pressurized liquid from the fore chamber, that the flow quantity of the pressurized liquid discharged form the fore chamber and flowing through the valve means is controlled in accordance with the position of the piston during the forward movement thereof thereby varying the speed of the piston, that valve means is connected between the rear chamber of the injection cylinder and a plurality of gas accumulators, and that the valve means is controlled so as to adjust the rate of increase of the pressure applied to the molten metal at the final stage of the injection casting.

DESCRIPTION OF THE PREFERRED EMBODIMENTS

Figure 1:
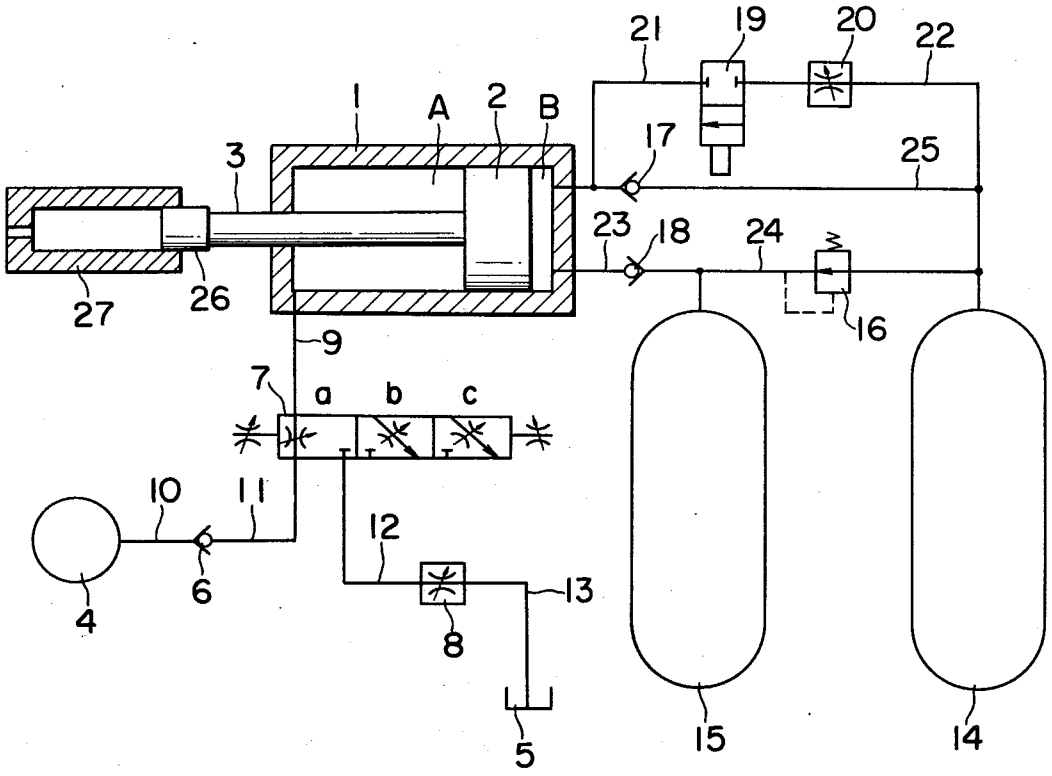
FIG. 1 is a connection diagram, partly in section, of an injection die casting machine embodying the invention.

A preferred embodiment of this invention shown in FIG. 1 comprises an injection cylinder 1 containing a piston 2 provided with a piston rod 3. The piston 2 divides the interior of the cylinder 1 into a fore chamber A and a rear chamber B. Pressurized liquid is supplied from source 4 to the fore chamber A via a check valve 6, conduits 9, 10 and 11 and a direction transfer valve 7 which is used to change the direction of flow of the pressurized liquid supplied by the source 4. The transfer valve 7 is actuated to move from position *b* to position *c* by an electrical signal from a limit switch or timer, or a mechanical signal from a cam (all not shown) which are produced when the piston rod 3 advances to a predetermined position. The fluid passage at position *c* is made larger than that at position *b*. In other words, the rate of flow is larger at position *c* than at position *b*.

Figure 7:
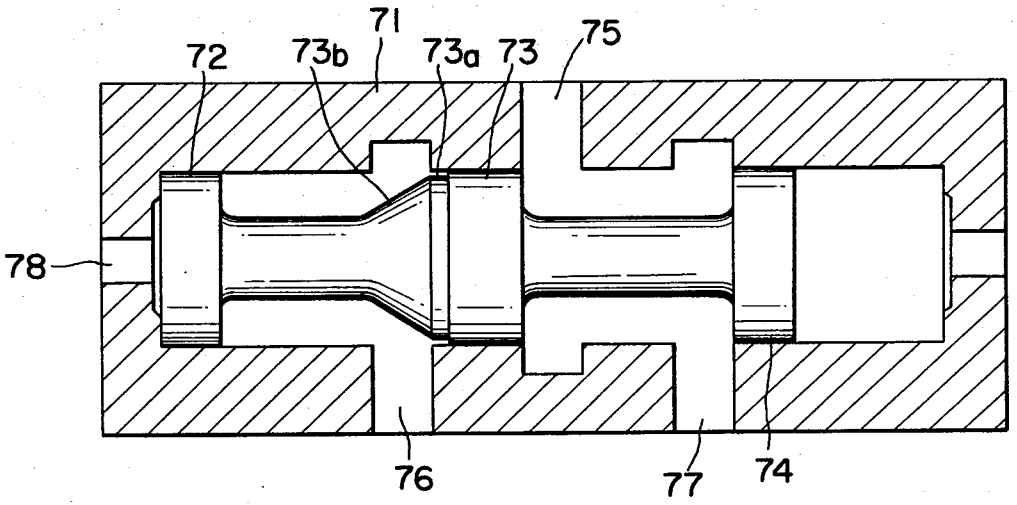
FIG. 7 is a longitudinal sectional view showing a portion of the direction transfer value 7 shown in FIG. 1.

For the purpose of varying the rate of flow of the pressurized liquid supplied to the fore chamber A of cylinder 1 the lefthand section of transfer valve 7 is constructed as shown in FIG. 7. Thus, the transfer valve 7 comprises a casing 71, and a spool having three spaced lands 72, 73 and 74. Port 75 is communicated with the fore chambaer A of cylinder 1, port 76 with source 4 and port 77 with a reservoir 5 to be described later. The intermediate land 73 is provided with a reduced diameter portion 73*a* and a conical portion 73b. In the position shown, the chamber A is communicated with the reservoir through ports 75 and 77. When pressurized liquid is supplied to port 78 under the control of an electromagnetic valve, not shown, or a mechanical force is applied to the lefthand side of the land 72, the spool is moved toward right. Then, a small quantity of the pressurized liquid is supplied to chamber A from the cource 4 via the reduced diameter portion 73*a*. As the spool is moved further, the flow rate of the pressurized liquid is increased gradually by the conical portion 73*b*. Finally, the land 73 is moved to a position intermediate of ports 75 and 77 thus fully communicating ports 75 and 76 and interrupting the communication between ports 75 and 77.

Accordingly, in the coarse of transferring from position *b* to position *c*, the flow rate is controlled in accordance with the stroke of the spool. If the speed of the spool is controlled, it is possible to control as desired the rate of increase in the flow quantity per unit time. Further a flow control valve 8 is provided for controlling the flow quantity of the pressurized liquid which flows from the valve 7 to a reservoir 5 when the transfer valve 7 is moved to position *c* so that the maximum speed of the liquid will not exceed a predetermined value during the forward movement of the injection piston. A low pressure gas accumulator 15 is connected to the rear chamber B through a check valve 18 and a conduit 23 whereas a high pressure gas accumulator 14 is connected to the low pressure gas accumulator 15 through a pressure reducing valve 16 and a conduit 24 for supplementing energy when piston 2 advances. The accumulators 14 and 15 are connected to the rear chamber B via conduits 21 through 24. A check valve 17 is connected in conduit 25 for passing gas from chamber B to high pressure accumulator 14 while check valve 18 passes the gas from the low pressure accumulator 15 to chamber B. In series with conduit 21 and 22 are provided a gas interception valve 19 operated by an electric coil (not shown) or fluid pressure or an external force to intercept the flow of gas to the chamber B from the high pressure accumulator 14 and a flow control valve 20.

The operation of the die cast machine will now be described. At first the relationship between the pressures of the gasses in the high and low pressure gas accumulators 14 and 15 will be described. When the pressure receiving area $A_1$ of piston 2 in the fore chamber A is made to be smaller than that $B_1$ in the rear chamber B, and when the pressures of the liquid and gas are denoted by $P_L$ and $P_G$ respectively, to retract (to move toward right) the piston 2, it is necessary to establish a relation $PG < PL \times (B_1A_1)$. Further, the pressure reducing valve 16 is adjusted such that it sets the pressure of the gas from the low pressure accumulator 15 and acting in the rear chamber B to a predetermined value during the forward movement of piston 2. Further, the gas interception valve 19 is maintained in the closed state as shown in FIG. 1.

After setting the pressures of the liquid and gas in this manner, the source 4 of the pressurized liquid is operated. Then the pressurized liquid is supplied to the chamber A via conduit 10, check valve 6, conduit 11, transfer valve 7 at position a and conduit 9, so that the piston retracts until it is stopped at a limit position. During this retraction stroke the gas in chamber B is forced back into the high pressure accumulator 14 through check valve 17 and conduit 25 thereby storing energy.

To inject molten metal into the mould cavity, the direction transfer valve 7 is switched to position b where it restricts the flow quantity. Then, the liquid in the fore chamber A is discharged into reservoir 5 via conduit 9, transfer valve 7, conduit 12, flow control valve 8 and conduit 5. On the other hand, the gas in the low pressure accumulator 15 flows into chamber B and the gas discharge from accumulator 15 is supplemented by the gas from the high pressure accumulator 14 through pressure reducing valve 16. Consequently the gas pressure in chamber B is set by valve 16 so that the piston 2 is advanced at a relatively low speed. The speed of advancement is controlled by the degree of opening of transfer valve 7 at position b and the flow control valve 8.

When the piston rod 3 reaches a predertermined position the direction transfer valve 7 is switched from position *b* to position *c* permitting larger flow quantity so that the quantity of the liquid discharged from chamber A increases thus advancing the piston 2 at a higher speed to inject at a higher speed the molten metal in an injection sleeve 27 into the cavity of a metal mould, not shown, by an injection plunger 26 secured to the outer end of pistion rod 3.

It is a feature of this invention that the flow quantity of the liquid discharged from chamber A is increased during an interval while the transfer valve 7 is switched from position *b* to position *c*, and that the flow quantity per unit time is also controlled. Accordingly, by switching the direction transfer valve 7 from position *b* to position *c* while the injection plunger 26 is injecting the molten metal into the cavity of the metal mould, that is while the piston 2 is moving at a high speed, it is possible to move the injection plunger at any desired acceleration rate. Accordingly, the discontinuity of the flow of the molten metal injected into the mould cavity through the gate can be prevented efficiently thus producing a high quality casting. The flow quantity of the liquid is controlled by control valve 8 so that the forward speed of piston 2 will not become excessive.

In the pressurizing step in which the injection plunger 26 applies a pressure to the molten metal filled in the mould cavity, that is in the step in which the piston 2 transmits pressure to the injecton plunger after the high speed advancement of the piston 2 has been completed gas interception valve 19 is opened to supply high pressure gas into the rear chamber B from the high pressure accumulator 14 via conduits 12 and 22 and valves 19 and 20.

This arrangement provides another feature. The variation in the gas pressure in chamber B and the variation in the speed of piston 2 with reference to an interval T in which the piston 2 starts its forward movement at a low speed and completes its high speed movement are shown by the graphs depicted in FIGS. 2 and 3 respectively in which the ordinate represents the gas pressure P in chamber B and the speed V of piston 2 respectively, and the abscissa represents the interval or time T during which piston 2 and injection plunger 26 advance. A solid line Pa shown in FIG. 2 shows one example of the variation in the gas pressure in chamber B whereas solid line V*a* in FIG. 3 shows one example of the variation in the speed of the piston 2.

Figure 2:
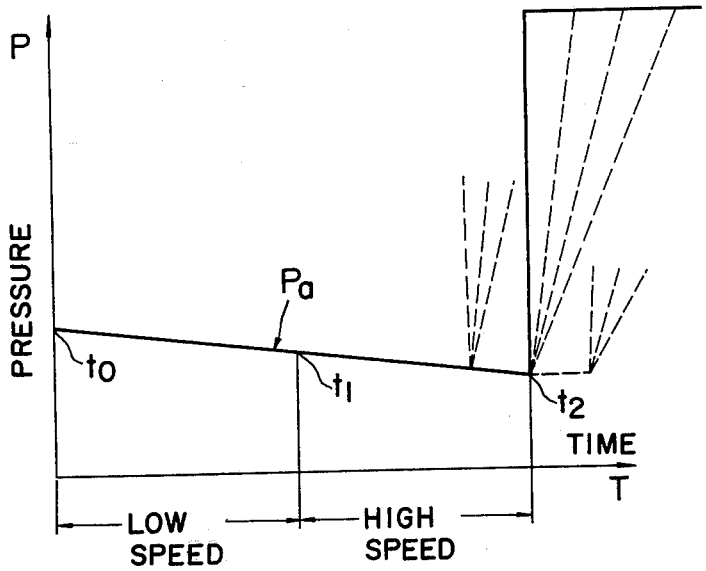
FIG. 2 is a graph showing the relationship between the interval T in which the injection plunger accelerates from a low initial speed to a high final speed during the forward stroke and the gas pressure P in cylinder chamber B.
Figure 3:
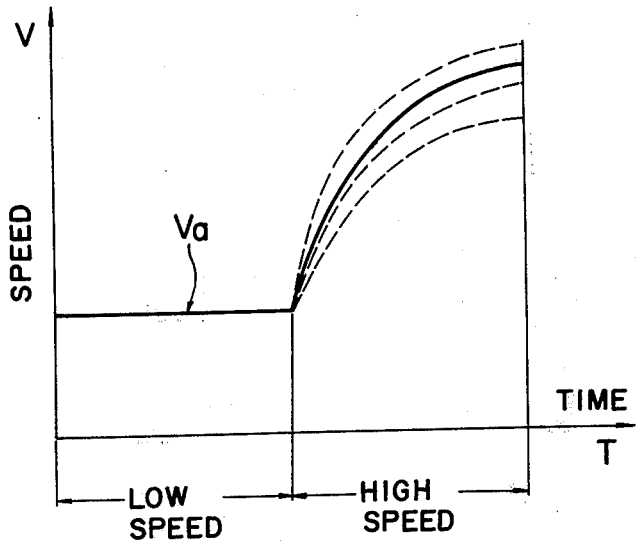
FIG. 3 is a graph showing the relationship between the interval T and the speed of the injection plunger.

As can be noted from FIG. 2 during the intervals $t_o$–$t_1$ and $t_1$–$t_2$ in which the piston 2 is advancing at low and high speeds respectively the pressure in rear chamber B is substantially the same as that in the low pressure accumulator 15. However at point $t_2$ where the high speed forward movement of piston 12 completes, that is the injection of the molten metal into the mould cavity has been completed and the piston stops, the gas in the high pressure accumulator 14 is supplied into the chamber B through gas interception valve 19 and flow control valve 20 so that the pressure increases rapidly. By opening valve 19 before or after point $t_2$ it is possible to increase the pressure at a point before or after point $t_2$ as shown by dotted lines in FIG. 2. Further, it is possible to adjust the time required for pressure rise by adjusting the degree of opening of the flow control valve 20. In this manner, as it is possible to increase the pressure in the rear chamber, at or before or after the point of completion of the high speed forward movement of the piston 20, no water hammering phenomenon occurs in the cylinder chambaer B in any range of adjustment.

To retract the piston 2, direction transfer valve 7 is returned to position *a* and the gas valve 19 is closed. Then the pressurized liquid is supplied to the fore chamber A from source 4 via conduits 10, 11 and 9, check valve 6 and transfer valve 7 so as to retract piston 2. Then, the gas in chamber B is returned to the high pressure accumulator 14 through check valve 17 and conduit 25 thus storing energy. As described above, the gas in the high pressure accumulator 14 is supplemented to the low pressure accumulator supplied each time the piston advances.

Figure 4:
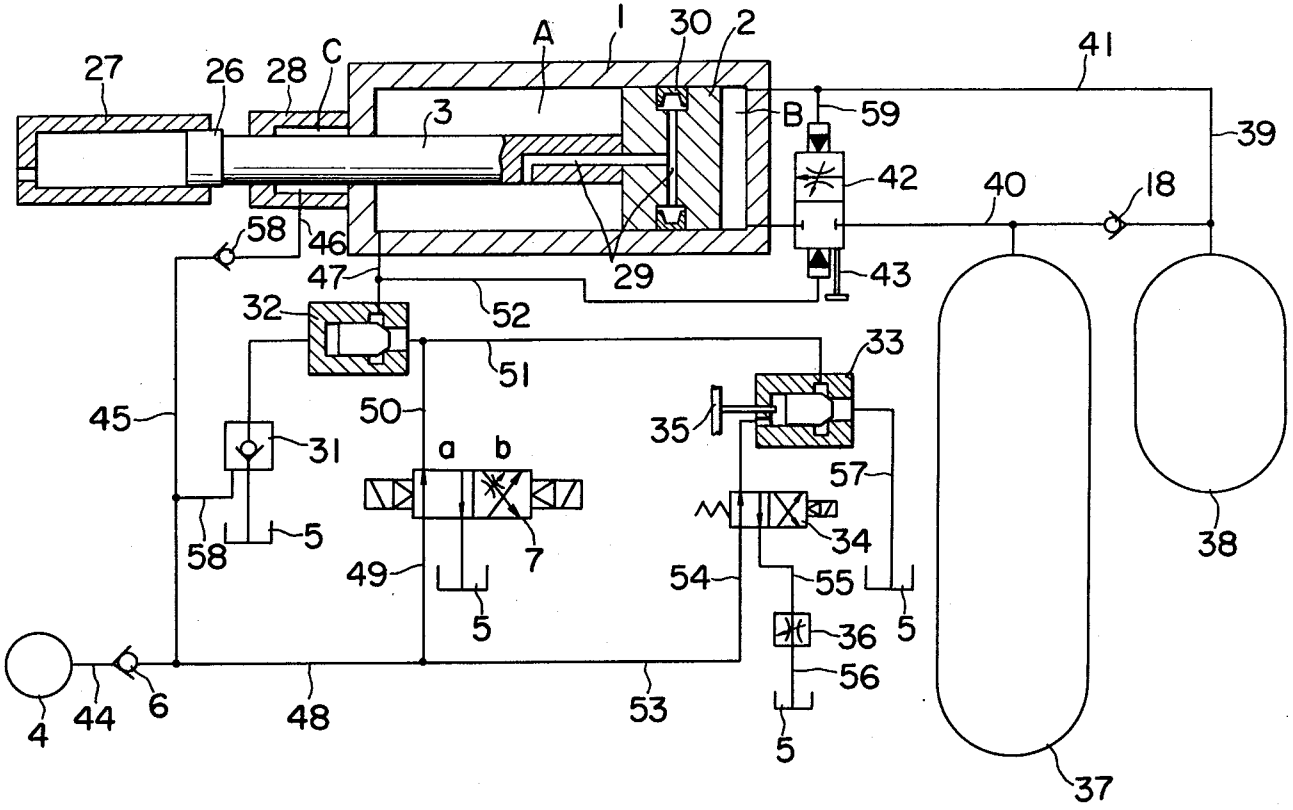
FIG. 4 is a connection diagram showing a modified embodiment of this invention.

FIG. 4 shows a modified embodiment of this invention in which elements corresponding to those shown in FIG. 1 are designated by the same reference numerals. In this modification, a cylinder 28 is connected to the fore end of cylinder 1 to form a chamber C. Passage 29 and a sealing packing 30 are provided for the rear end of the piston rod 3 and piston 2 so that when the piston 2 approaches its forward limit the pressurized liquid supplied to chamber C via conduits 44 and 45 and check valves 6 and 58 is upplied to the inside of sealing packing 30 via passages 29 to provide an efficient seal between the inner wall of cylinder 1 and the periphery of piston 2. For the purpose of preventing misoperation of the piston 2 there are provided a pilot check valve 31 and a safety check valve 32 which are connected to be opened by the pressurized liquid from source 4. Thus, when the supply of the pressurized liquid is stopped due, for example, to the interruption of electric supply, safety check valve 32 is closed by pilot valve 31. A pilot check valve 33 is provided for advancing piston 2 at a high speed. When piston 2 advances to a predetermined position, an electric, hydraulic or mechanical signal is generated to operate a direction transfer valve 34 for discharging the pressurized liquid in the check valve 33, thus opening the same. Accordingly, the pressurized liquid in cylinder chamber A is discharged into reservior 5 via conduits 47 and 51 and valves 32 and 33 thus permitting piston 2 to advance at a high speed. the check valve 33 is provided with a maximum flow quantity controlling handle 35 for adjusting the degree of opening of the valve 33 and hence to maximum speed of the piston. A flow control valve 36 is included between conduits 55 and 56 from transfer valve 34 for controlling the flow quantity of the pressurized liquid passing through check valve 33 thus fastening or delaying the opening of the check valve 33. An accumulator 37 having a large capacity and an accumulator 38 having a small capacity are connected to cylinder chamber B through conduits 39, 40 and 41, and a check valve 18 is connected between accumulators 37 and 38. A gas interception valve 42 is connected in the conduit 40. Valve 42 is opened and closed by the pressure of the pressurized liquid in chamber A or the pressure of the gas in the small accumulator 38. When valve 42 is opened the gas in the large accumulator 37 is supplied to chamber B but when valve 42 is closed the gas in the small accumulator 38 is supplied to chamber B. Gas interception valve 42 is provided with a flow rate controlling handle 43. Thus, by controlling the speed of the opening the gas valve 42 the rate of pressure rise in chamber B can be controlled.

The modification shown in FIG. 4 operates as follows. Similar to FIG. 1, the relationship between the liquid pressure of source 4, and the gas pressures in the large and small gas accumulators 37 and 38 is established to satisfy a relation $(A_1/B_1) \times P_L > PG$ where $A_1$, $B_1$, $P_L$ and $P_G$ have the same meaning as above described. Further, the operating coil (not shown) of the direction transfer valve 34 is deenergized, check valve 33 and gas interception valve 42 are maintained in the closed position.

Then the source 4 is started to supply the pressurized liquid to pilot check valve 31 via check valve 6, conduits 44 and 58, thus opening the pilot check valve 31. Consequently safety check valve 32 is also opened.

Assume now that the direction transfer valve 7 is held in position *a* under these conditions. Then the pressurized liquid is supplied to chamber A through conduits 48 and 49, transfer valve 7, conduit 50, safety check valve 52 and conduit 47. On the other hand, since chamber B is communicated with small gas accumulator 38 via conduits 41 and 39, piston 2 is retracted. Under these conditions the gas in chamber B is forced back into large and small accumulators 37 and 38 thus storing energy.

When the direction transfer valve 7 is moved to position *b*, the liquid in chamber A is discharged into reservoir 5 via conduit 47, safety check valve 32, conduit 50, and through the controllable passage in transfer valve 7 at a relatively small flow rate. Accordingly, the piston 2 begins to advance at a low speed by the gas from the small gas accumulator 38. The speed of the piston can be controlled according to the degree of opening of the transfer valve 7.

When the piston rod advances to a predetermined position, the direction transfer valve 34 is actuated to open pilot check valve 33. Then the liquid in chamber A is discharged into reservior 5 via conduit 51, check valve 33 and conduit 57 so that piston 2 moves at a high speed. In this modification, the opening speed of check valve 33 is controlled by the degree of opening of the flow control valve 36 so that it is possible to gradually or rapidly change the speed of piston 2 from low speed to high speed and to vary the acceleration of the piston. The maximum speed of the piston under various conditions is determined by the maximum flow quantity controlling handle 35.

Considering the liquid pressure in chamber A and the gas pressure in chamber B during the forward stroke of the piston, as the pressure receiving area $A_1$ of the piston 2 is smaller than the pressure receiving area $B_1$ the liquid pressure is higher than the gas pressure in reverse proportion to the ratio of areas $A_1$ and $B_1$. Accordingly the gas interception valve 42 is maintained in the closed condition by the liquid pressure applied thereto through conduits 47 and 52. While the piston is moving forwardly as the gas in the small accumulator 38 is continuously supplied to chamber B, the gas in the accumulator 38 expands and decreases its pressure.

When the injection plunger 26 completes filling of the molten metal in the sleeve 27 into the mould cavity, that is when the piston completes its high speed forward movement and stops, the pressure in chamber A instantly decreases to atmospheric pressure so that the pressure in conduit 52 decreases also. Consequently, the gas interception valve 42 is opened by the gas pressure in the small accumulator 38 and acting through conduit 59 whereby the gas in the large accumulator 37 flows into chamber B.

In this embodiment, the time of pressure rise in chamber B can be adjusted to any desired value by varying the degree of opening of gas interception valve 42 by flow quantity control handle 43 thus varying the quantity of gas flowing into cylinder B. Thus, when the degree of opening of the gas interception valve 42 is reduced by the manipulation of the flow quantity control handle 43, the gas pressure in chamber B increases slowly, whereas when the degree of opening of the gas interception valve is increase, the gas pressure in chamber B increases rapidly.

Figure 5:
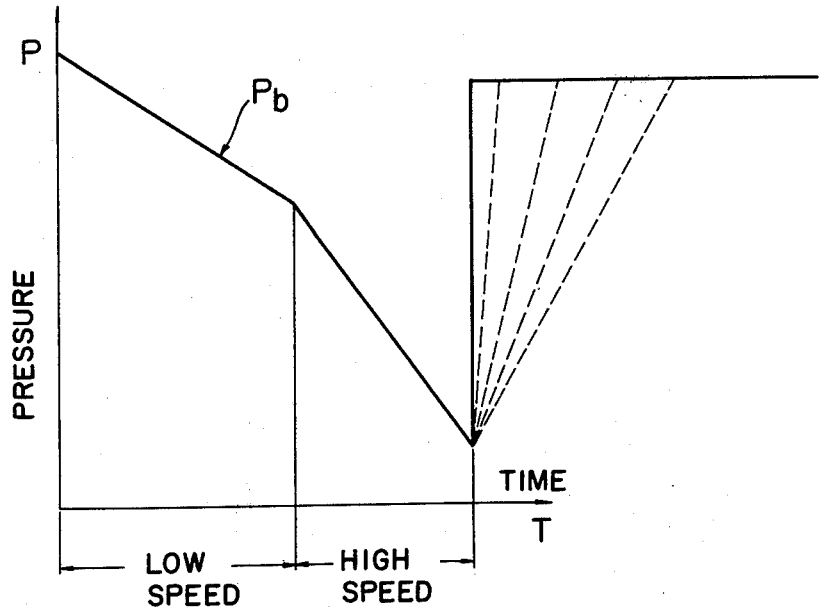
FIGS. 5 and 6 are graphs corresponding to those shown in FIGS. 2 and 3 showing te operating characteristics of the modified embodiment shown in FIG. 4
Figure 6:
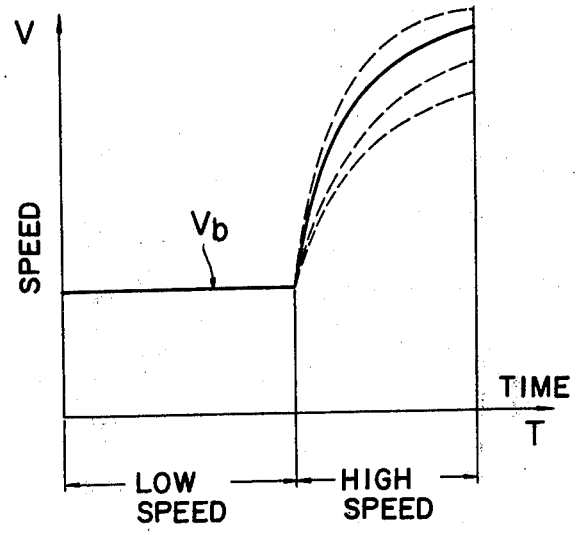

The variations in the gas pressure in chamber B and the speed of piston 2 with reference to time are shown by the graphs shown in FIGS. 5 and 6 where the ordinate represents the gas pressure P (FIG. 5) and piston speed V (FIG. 6) and the abscissa represents the time T. Solid line P*b* in FIG. 5 shows one example of the variation in the gas pressure in chamber B and solid line V*b* in FIG. 6 shows one example of the speed variation of piston 2.

As can be noted from FIG. 5, inasmuch as the gas pressure in chamber B is governed by the expansion of the gas in the small accumulator 38, the pressure decreases with the advancement of piston 2 and rises rapidly when the high speed forward movement of the piston completes. The rate of pressure rise can be controlled variously by the manipulation of the control handle 43 as shown by dotted lines. As shown by solid curve V*b* shown in FIG. 6, the forward high speed of piston 2 is caused to increase with time and accelerated near the end of the forward stroke by the manipulation of the maximum flow quantity control handle 35. This rate of speed increase can be varied variously as shown by dotted lines. In this manner it is possible to impart an ideal motion to the injection plunger 26 for injecting the molten metal into the mould cavity and applying a suitable pressure to the injected molten metal.

To retract the injection plunger 27 the direction transfer valves 7 and 34 are switched to the position shown. Then the pilot valve 33 is closed by the pressurized liquid supplied thereto through conduit 53 and the pressurized liquid is supplied to chamber A from source 4 via check valve 6, conduits 48 and 49, transfer valve 7, conduit 50, check valve 32 and conduit 47. As a result, piston 2 is moved to the right and the gas in chamber B is forced back into the large and small accumulators 37 and 38 to store energy.

In this embodiment, although the connection between the cylinder 1 and the gas accumulators is slightly different from that shown in FIG. 1 injection plunger 26 is operated in the same manner.

Furthermore, instead of introducing gas in chamber B and liquid in chamber A, the same object can also be accomplished by introducing gas in chamber A, liquid in chamber B and moving cylinder 1 while maintaining piston 2 stationary.

As above described, according to this invention it is possible to fasten or delay the time of pressure rise in the mould cavity when the injection plunger completes its high speed forward movement and to vary the rate of pressure rise. It is also possible to cause the injection plunger to smoothly transit from a low speed to a high speed forward movement and to vary the rate of acceleration during the high speed movement. Consequently it is possible to improve the quality of the cast product. According to this invention materials that could not be die cast can be satisfactory cast.

I claim:

1. In a die cast machine including an injection cylinder and a piston contained therein for operating an injection plunger for injecting molten metal into a mould cavity, said piston dividing the interior of said cylinder into a fore chamber and a rear chamber, means for admitting pressurized gas from gas accumulator means into said rear chamber for advancing said piston and said injection plunger for injecting the molten metal into said mould cavity, and means for admitting pressurized liquid into said fore chamber to retract said piston thereby forcing the gas in said rear chamber back into said gas accumulator means, the improvement which comprises a control valve means connected in the discharge path of said pressurized liquid from said fore chamber, means for controlling the flow quantity of the pressurized liquid dicharged from said fore chamber and flowing through said control valve means in accordance with the position of said piston during the forward movement threof, thereby varying the speed of said piston, a plurality of gas accumulators, rear valve means connected between the rear chamber of said injection cylinder and said plurality of gas accumulators, and means for controlling said rear valve means so as to adjust the rate of increase of the pressure applied to the molten metal at the final stage of the injection casting operation.

2. The die cast machine according to claim 1 wherein said rear chamber is connected to a low pressure gas accumulator through a check valve permitting gas flow from said low pressure gas accumulator to said rear chamber, a high pressure gas accumulator is connected to said low pressure gas accumulator via a pressure reducing valve, said rear chamber is connected to said high pressure gas accumulator through a check valve permitting gas flow from said rear chamber to said high presssure gas accumulator and through serially connected gas interception valve and a flow control valve.

3. The die casting machine according to claim 1 wherein a small gas accumulator is connected directly to said rear chamber, a large gas accumulator is connected to said rear chamber via a gas interception valve, said small and large gas accumulators are interconnected through a check valve permitting gas flow said small gas accumulator to said large gas accumulator, and said gas interception valve is operated in accordance with the gas pressure in said small gas accumulator and the liquid pressure in said fore chamber.

4. The die casting machine according to claim 3 wherein said gas interception valve is provided with flow control means.

5. The die casting machine according to claim 1 wherein said control valve means comprises a direction transfer valve having a first passage for supplying pressurized liquid to said fore chamber of the cylinder, and second and third passages having different flow rate for passing the pressurized liquid discharged from said fore chamber and means to switch the transfer valve from one passage to the other, and a flow contol valve connected in series with said second or third passage.

6. The die cast machine according to claim 1 wherein said control valve means comprises a first transfer valve having a first passage for supplying pressurized liquid to said fore chamber and a second passage for passing the pressurized liquid discharged from said fore chamber and means for swtiching said first transfer valve between said first and second passages, a pilot check valve connected to said fore chamber to discharge the pressurized liquid therefrom at a higher rate than said second passage of said first transfer valve, and a second transfer valve which is operated when said piston reaches a predetermined position during its forward movement for opening said pilot check valve.

7. The die cast machine according to claim 6 wherein said pilot check valve is provided with means for adjusting maximum speed of said piston during the forward movement thereof.

8. The die cast machine according to claim 6 wherein said control valve means further comprises a safety check valve connected between said fore chamber and said first transfer valve and said pilot check valve, and means for closing said safety check valve when the pressure of said pressurized liquid decreases.

9. The die cast machine according to claim 1 which further comprises an additional cylinder connected to the fore end of said injection cylinder to surround a piston rod of said piston to form a space between the inner surface of said additional cylinder and said piston rod, means to supply pressurized liquid into said space, and a sealing member provided about the periphery of said piston, said piston rod and said piston being provided with passages for supplying the pressurized fluid in said space to said sealing member.

* * * * *